US011725378B2

(12) United States Patent
Adams et al.

(10) Patent No.: US 11,725,378 B2
(45) Date of Patent: Aug. 15, 2023

(54) BOLTED BEAM TO COLUMN CONNECTIONS

(71) Applicant: MITEK HOLDINGS, INC., Wilmington, DE (US)

(72) Inventors: Jared J Adams, Mission Viejo, CA (US); Behzad Rafezy, Laguna Niguel, CA (US); Quang Minh Huynh, San Diego, CA (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 17/097,878

(22) Filed: Nov. 13, 2020

(65) Prior Publication Data

US 2021/0140168 A1 May 13, 2021

Related U.S. Application Data

(60) Provisional application No. 62/934,967, filed on Nov. 13, 2019, provisional application No. 63/015,252, filed on Apr. 24, 2020.

(51) Int. Cl.
*E04B 1/24* (2006.01)
*E04B 1/41* (2006.01)
(Continued)

(52) U.S. Cl.
CPC ..... *E04B 1/2403* (2013.01); *E04B 1/40* (2013.01); *E04C 3/06* (2013.01); *E04C 3/32* (2013.01);
(Continued)

(58) Field of Classification Search
CPC .. E04B 1/2403; E04B 1/40; E04B 2001/2415; E04B 2001/2418;
(Continued)

(56) References Cited

U.S. PATENT DOCUMENTS 574,433 A 1/1897 Keitiiley
1,970,965 A 8/1934 Leake
(Continued)

FOREIGN PATENT DOCUMENTS

CN 107816131 A 3/2018
CN 108331163 A 7/2018

OTHER PUBLICATIONS

International Search Report & Written Opinion dated Feb. 11, 2021 in related PCT application PCT/US20/60519, 14 pages.
(Continued)

*Primary Examiner* — Rodney Mintz
(74) *Attorney, Agent, or Firm* — Stinson LLP

(57) ABSTRACT

A joint connection structure of a building framework includes a column assembly including a column and a pair of side plates attached to the column on opposite sides of the column and extending laterally outward from the column. A beam assembly includes a beam having an end portion received between the side plates. At least one of the column and the beam has an opening in an area between the side plates to provide access for bolting at least one of the side plates to one of the column and the beam. The opening is free of a fastener extending through the opening when the column assembly is attached to the beam assembly.

19 Claims, 20 Drawing Sheets

(51) Int. Cl.
*E04C 3/06* (2006.01)
*E04C 3/32* (2006.01)
*E04C 3/04* (2006.01)

(52) U.S. Cl.
CPC ..... *E04B 2001/2415* (2013.01); *E04B 2001/2418* (2013.01); *E04B 2001/2451* (2013.01); *E04B 2001/2466* (2013.01); *E04C 2003/0452* (2013.01); *E04C 2003/0465* (2013.01)

(58) Field of Classification Search
CPC ..... E04B 2001/2451; E04B 2001/2466; E04B 2001/2472; E04C 3/06; E04C 3/32; E04C 2003/0452; E04C 2003/0465; E04H 9/024
See application file for complete search history.

(56) References Cited

U.S. PATENT DOCUMENTS 2,441,890 A 5/1948 Larkin
2,607,450 A 8/1952 Horowitz
3,672,711 A 6/1972 Red
5,412,913 A 5/1995 Daniels et al.
5,680,737 A * 10/1997 Sheipline ..... F16B 7/0453 403/205
7,231,742 B2 * 6/2007 Majlessi ..... E04B 1/24 52/693
8,959,747 B2 * 2/2015 Calhoun ..... E04C 3/40 29/525.01
9,091,065 B2 7/2015 Tran et al.
9,441,360 B2 * 9/2016 Matteson ..... E04B 1/40
9,506,239 B2 11/2016 Houghton
9,523,188 B2 * 12/2016 Rahimzadeh ..... E04C 3/293
9,988,808 B2 * 6/2018 Rahimzadeh ..... E04B 5/12
10,273,677 B2 * 4/2019 Green ..... F16B 7/042
10,316,507 B2 6/2019 Richards
10,584,477 B2 * 3/2020 Richards ..... E04B 1/98
10,711,450 B2 * 7/2020 Green ..... E04B 1/2403
10,760,261 B2 9/2020 Richards
11,002,011 B2 * 5/2021 Small ..... E04C 3/06
2002/0184836 A1 12/2002 Takeuchi et al.
2005/0229509 A1 * 10/2005 Majlessi ..... E04C 2/384 52/167.3
2006/0265992 A1 * 11/2006 Hiragaki ..... E04B 5/43 52/633
2007/0163204 A1 7/2007 Ceba et al.
2008/0016793 A1 * 1/2008 Majlessi ..... E04B 1/24 52/167.3
2008/0178551 A1 7/2008 Porter
2009/0162138 A1 * 6/2009 Burger ..... B62D 21/02 403/271
2011/0252743 A1 10/2011 Yang
2013/0167358 A1 * 7/2013 Calhoun ..... E04C 3/40 29/525.01
2014/0083046 A1 3/2014 Yang
2014/0325932 A1 * 11/2014 Tran ..... E04C 3/06 52/700
2015/0275501 A1 10/2015 Houghton
2016/0002910 A1 * 1/2016 Green ..... F16B 7/182 52/848
2016/0032580 A1 * 2/2016 Rahimzadeh ..... E04B 5/19 52/236.9
2016/0130798 A1 * 5/2016 Rahimzadeh ..... E04B 1/4114 52/282.1
2016/0208478 A1 * 7/2016 Matteson ..... E04C 3/32
2016/0356033 A1 12/2016 Houghton et al.
2017/0218616 A1 8/2017 Richards
2018/0094420 A1 4/2018 Houghton
2018/0274223 A1 9/2018 Richards
2018/0347222 A1 12/2018 Richards
2019/0211543 A1 * 7/2019 Abernathy ..... E04B 1/2403
2019/0249410 A1 * 8/2019 Richards ..... E04H 9/024
2019/0257071 A1 * 8/2019 Green ..... E04B 1/2403
2020/0018067 A1 * 1/2020 Small ..... G01B 1/00
2021/0140167 A1 * 5/2021 Adams ..... E04B 1/2403

OTHER PUBLICATIONS

Extended European Search Report for Application No. 20851404.2, dated Sep. 16, 2022, 23 pages, Munich, Germany.

* cited by examiner

BOLTED BEAM TO COLUMN CONNECTIONS

CROSS-REFERENCE TO RELATED APPLICATION

The present application claims the benefit of, and priority to, U.S. Provisional Application Ser. No. 62/934,967, which was filed Nov. 13, 2019 and U.S. Provisional Application Ser. No. 63/015,252, which was filed Apr. 24, 2020, the entireties of which is incorporated herein by reference for all purposes.

FIELD

The present disclosure is directed to bolted beam to column connections in buildings, particularly where one or both of the beam and column are box or hollow structures.

BACKGROUND

It has been found in a moment-resisting building having a structural steel framework, that most of the energy of an earthquake, or other extreme loading condition, is absorbed and dissipated, in or near the beam-to-column joints of the building.

In the structural steel construction of moment-resisting buildings, towers, and similar structures, most commonly in the past, the flanges of beams were welded to the face of columns by full-penetration, single bevel, groove welds. Thus, the joint connection was comprised of highly-restrained welds connecting a beam between successive columns. Vertical loads, that is, the weight of the floors and loads superimposed on the floors, were and still are assumed by many to be carried by vertical shear tabs or pairs of vertical, structural angle irons arranged back-to-back, bolted or welded to the web of the beam and bolted or welded to the face of the column. The greater part of the vertical load placed upon a beam was commonly assumed to be carried by a shear tab bolted or welded to the web of the beam and bolted or welded to the face of the flange of the column at each end of the beam. Through the use of face-to-face side plates welded to the column, the greater part of the vertical load is carried by the side plates.

Side plate connections require parallel juxtaposed reinforcing plates that extend across the column depth. For HSS (hollow structural section) columns and beams, there are restrictions for bolting the side plates to the column/beam depending on the length, size, and location of the side plates. Some conventional methods involve the use of 'blind' bolts which include a steel pin, collar, and sleeve. The blind bolts are inserted through pre-drilled holes and the pressure on the collar creates a solid connection as an expander deforms to hold the blind side firm while the collar creates a seal on the side where the tool is applied. Conventional methods also use welded threaded studs on the side of the of the HSS section. However, there are many fabrication tolerance issues related with these methods. The present disclosure provides structure that allows for typical fabrication accesses in the placement and usage of standard bolting techniques for connecting side plates to columns and beams.

SUMMARY

In one aspect, a joint connection structure of a building framework generally comprises a column assembly including a column and a pair of side plates attached to the column on opposite sides of the column and extending laterally outward from the column. A beam assembly includes a beam having an end portion proximate the side plates. At least one of the column and the beam has an opening in an area between the side plates to provide access for bolting at least one of the side plates to one of the column and the beam. The opening is free of a fastener extending through the opening when the column assembly is attached to the beam assembly.

In another aspect, a column assembly generally comprises a column and a pair of side plates bolted to the column on opposite sides of the column and extending laterally outward from the column. The column defines an opening disposed between the side plates providing access to an interior of the column for bolting the side plates to the column. The opening is free of a fastener for attaching one of the side plates to the column.

In yet another aspect, a beam for attachment to a column assembly generally comprises a beam including a top surface, a bottom surface, and a pair of side surfaces extending between the top and bottom surfaces. A plurality of bolt holes are in each of the side surfaces for receiving bolts to attach side plates of the column assembly to the beam. An opening is disposed in one of the top surface and bottom surface. The opening is free of a fastener when the side plates are attached to the beam.

BRIEF DESCRIPTION OF THE DRAWINGS

Corresponding reference characters indicate corresponding parts throughout the drawings.

DESCRIPTION OF THE PREFERRED EMBODIMENTS

Figure 1:
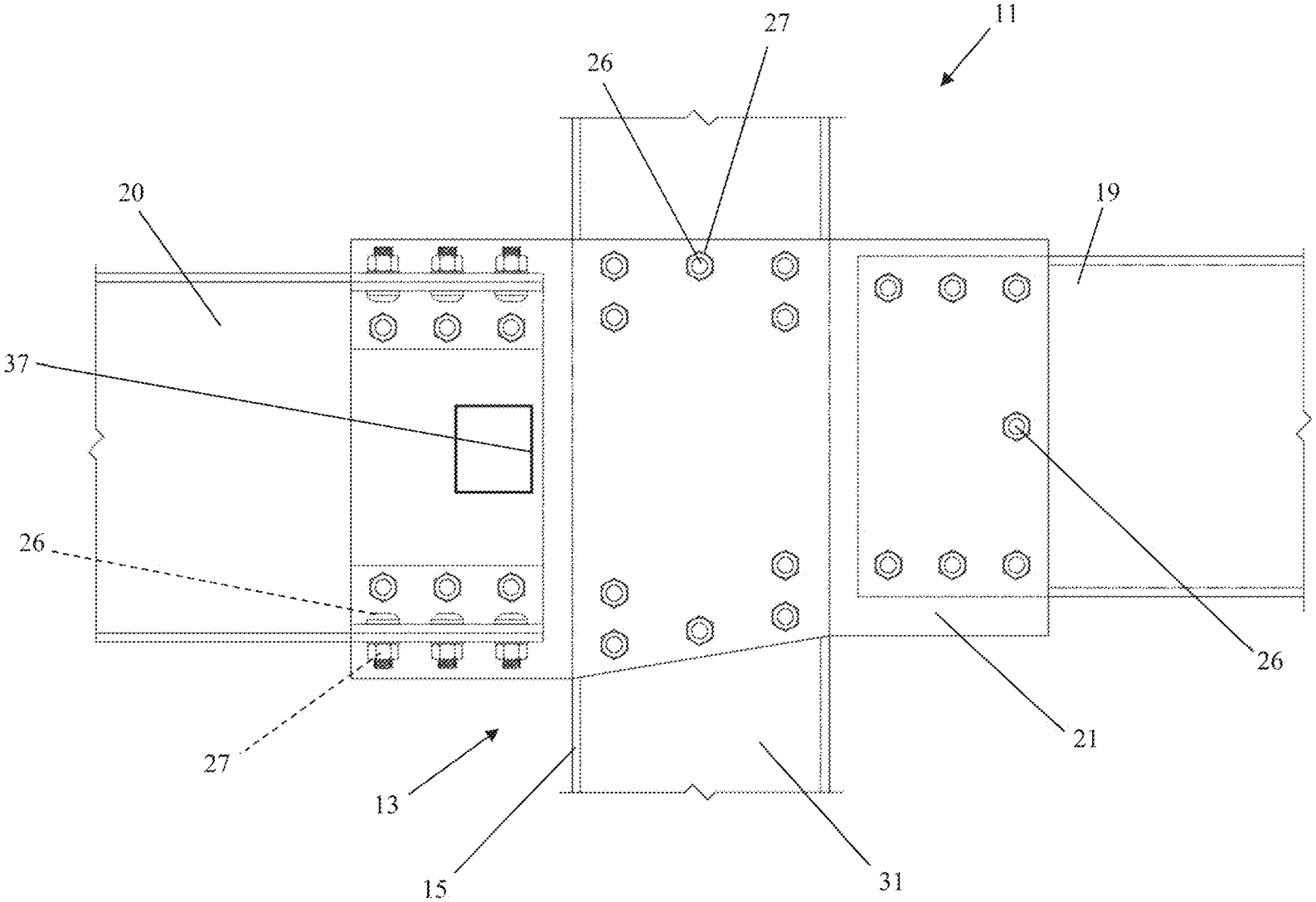
FIG. 1 is a front view of a beam-to-column-to-beam joint connection structure of the present disclosure.
Figure 2:
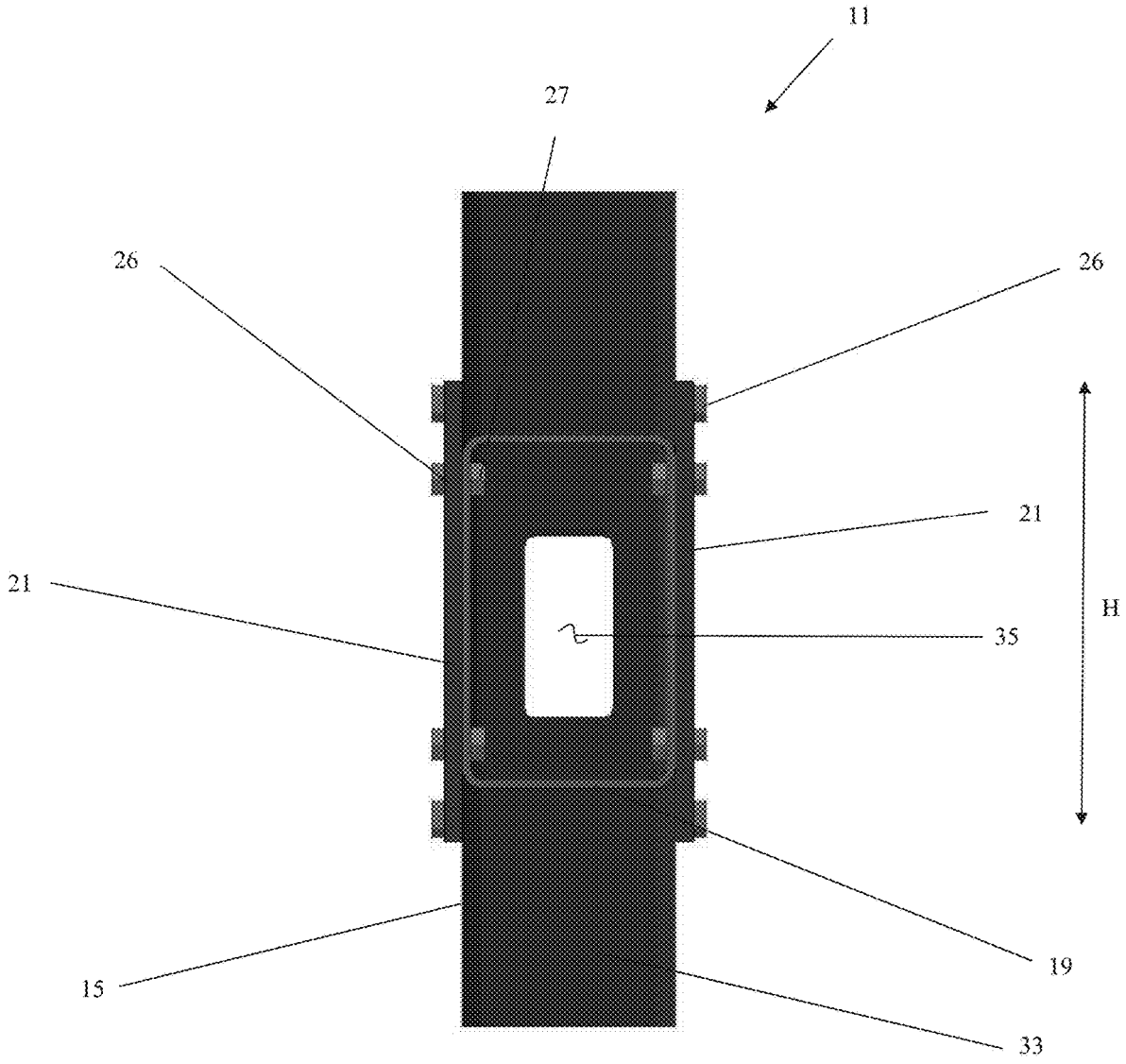
FIG. 2 is a right side view of the beam-to-column-to-beam joint connection structure of FIG. 1.
Figure 3:
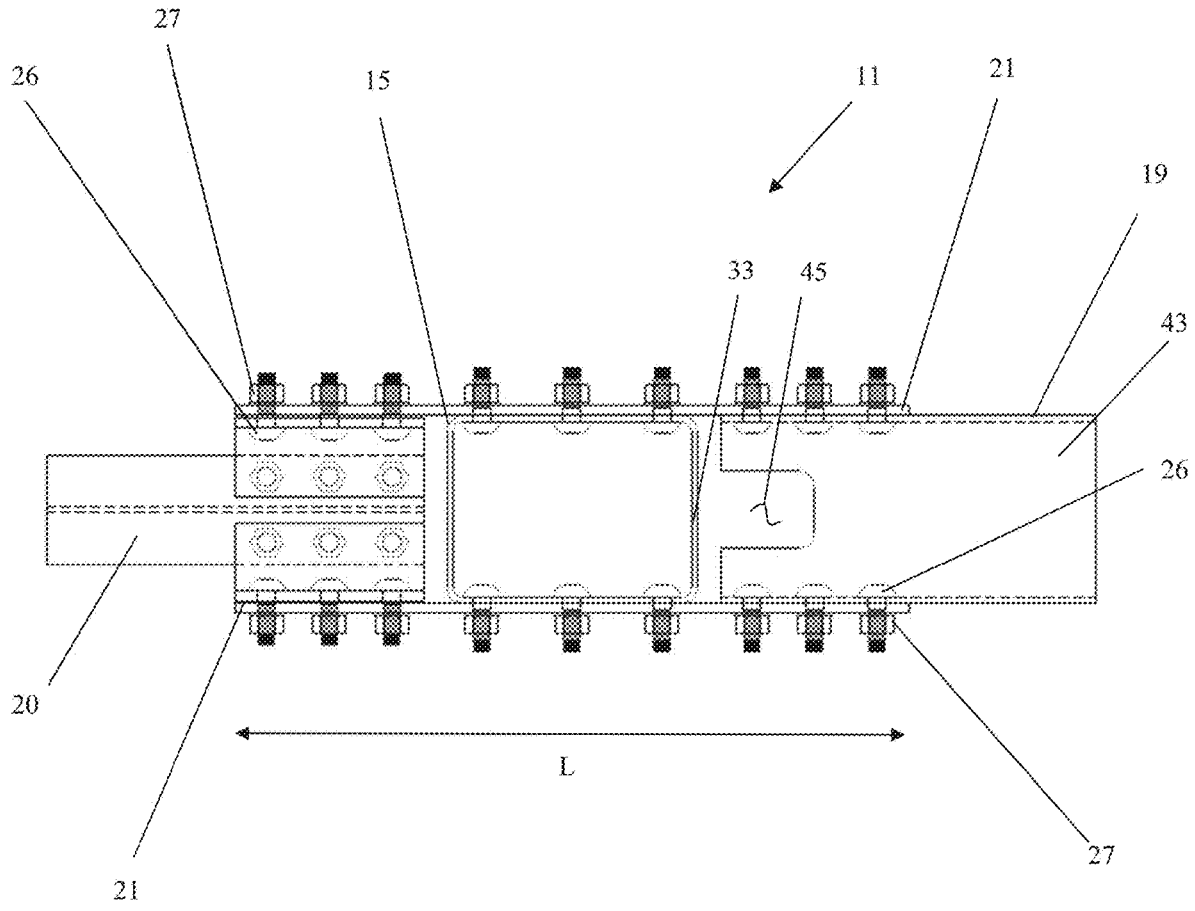
FIG. 3 is a top view of the beam-to-column-to-beam joint connection structure of FIG. 1.
Figure 4:
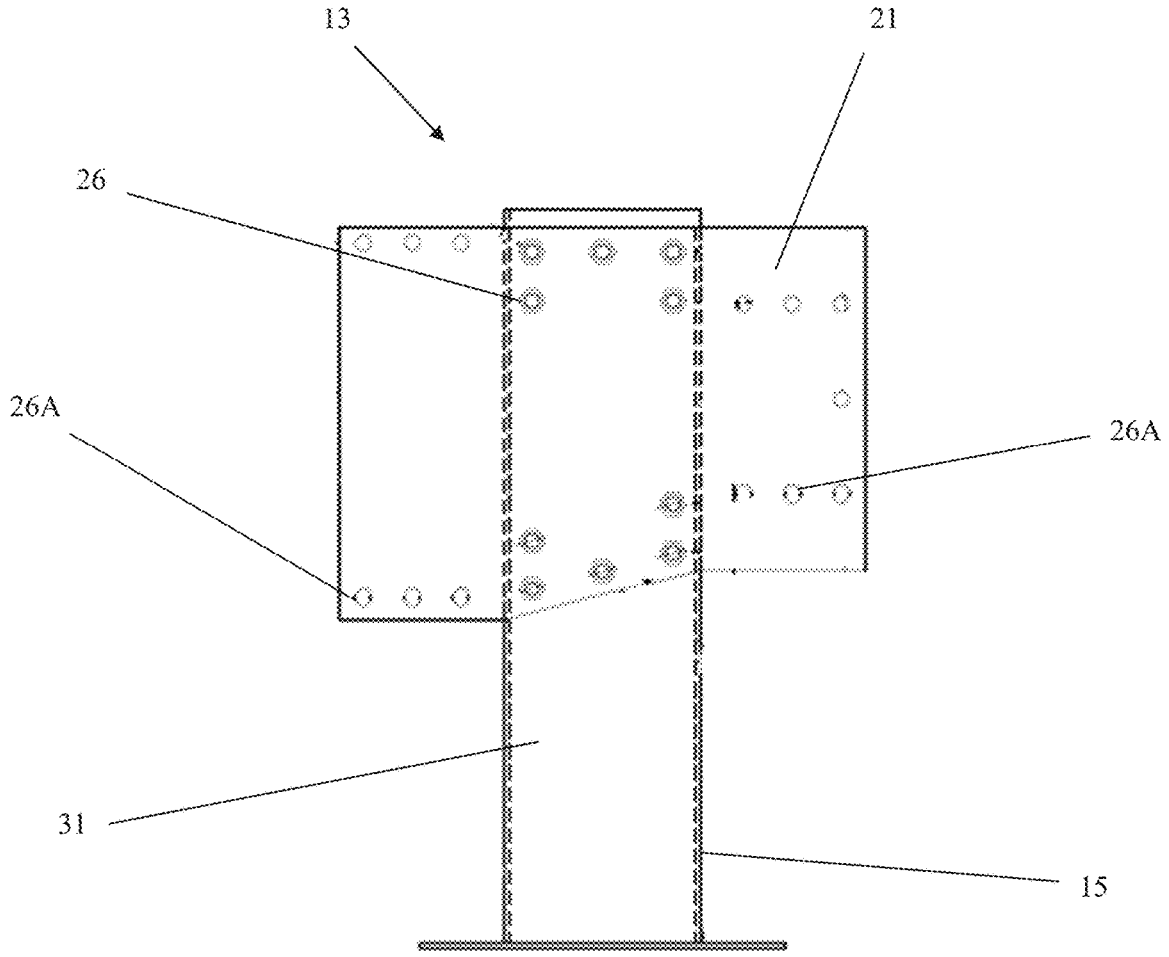
FIG. 4 is a front view of a column assembly of the beam-to-column-to-beam joint connection structure of FIG. 1.

Referring to FIGS. 1-3, a beam-to-column-to-beam moment-resisting joint connection structure of the present disclosure is shown generally at 11. The joint connection structure may be used in the construction of a building framework. In the illustrated embodiment, the joint connection joins a column assembly 13 including a column 15 to full-length beams 19 and 20 extending laterally outward from the column 15 in opposite directions and generally along a common longitudinal axis. A full-length beam is a beam that has a length sufficient to extend substantially the full length between adjacent columns in a structure. It will be understood that the joint connection structure may include a single column and a single beam, or additional beams and columns suitably connected without departing from the scope of the disclosure. Beams that extend less that the full length between adjacent columns may also be used within the scope of the present invention.

In the illustrated embodiment, the column 15 is an HSS (hollow structural support) column, beam 19 is a HSS beam, and beam 20 is an I-beam. However, the column 15 and beams 19, 20 could have other configurations without departing from the scope of the disclosure. A spaced apart pair of parallel, vertically and horizontally extending side plates 21 sandwich the column 15 and beams 19, 20. The side plates 21 have a length L (FIG. 3) extending horizontally across the side plates, and a height H (FIG. 2) extending vertically along the side plates. The side plates 21 are bolted to column 15 and to the beams 19, 20 using bolts 26. As will be explained in greater detail below, the construction of the column 15 is configured to provide access to fabricators for bolting the side plates 21 to the column and the beams 19, 20. Additionally, the construction of the HSS beam 19 is also configured to provide access for bolting the side plates to the HSS beam. To this effect, standard bolts 26 may be used to bolt the side plates 21 to the column 15 and to the beams 19, 20.

Referring to FIGS. 4-7, the column 15 comprises a hollow column having open longitudinal end. The column 15 could also have a closed end without departing from the scope of the disclosure. In the illustrated embodiment, the column 15 has a rectangular cross sectional shape defined by four side walls extending along a length of the column. A first pair of opposing side walls 31 extend across a major (i.e., larger) dimension of the column 15. The first pair of side walls 31 are configured for engagement with respective side plates 21 when the side plates are bolted to the column 15. In one embodiment, the side plates 21 extend along substantially an entire width of the first side walls 31. A second pair of opposing side walls 33 extend between the first pair of side walls 31 and define the smaller lateral dimension of the column 15. The second pair of side walls 33 are positioned to oppose ends of respective beams 19, 20 when the beams are bolted to the column assembly 13. It will be understood that the column 15 could have a square cross-sectional shape such that the first side walls 31 and second side walls 33 have the same lateral dimension. Additionally, the second side walls 33 could have a larger lateral dimension that the first side walls 31.

Referring back to FIGS. 1-3, the side plates 21 reinforce the column 15 and beams 19, 20, and reduce the stresses normally found across the second pair of side walls 33 when the column and beams are attached in other ways such as by directly welding or bolting the beams to the beam facing surfaces (i.e., side walls 33) of the column. In particular, the side plates 21 cause the stresses on the joint connection to be transferred to the sides of the joint along the side plates 21 away from the beam facing surfaces 33 of the column 15. Thus, the areas of the side walls 33 the column 15 between the side plates 21 constitute areas of relatively low stress within the joint connection.

Referring to FIGS. 2 and 5-7, at least one of the second pair of side walls 33 includes an opening 35. In the illustrated embodiment, openings 35 are formed in both of the second pair of side walls 33. However, only one of the side walls 33 may have an opening 35. The openings 35 have a generally rectangular shape with rounded corners. The openings 35 extend along the length of the column 15 such that a longitudinal axis of the openings extends generally parallel to the length of the column. However, the openings 35 could have other shapes and orientations without departing from the scope of the disclosure. For example, the openings 35 may have square corners or may be square shaped or the opening may be circular in shape. Additionally, the openings 35 may extend in other directions along the surface of the side walls 33. Bolt holes 26A (FIG. 7) in the first side walls 31 provide holes to receive the bolts 26 for attaching the side plates 21 to the column 15. The openings 35 in the side walls 33 are disposed between a top and bottom perimeter boundary of the bolt holes 26A in the column 15. Thus, the openings 35 provide access to fabricators to the interior of the column 15 at the location where the side plates 21 are bolted to the column so that standard bolts 26 can be used to attach the side plates to the column. In particular, bolts 26 that require a separate nut 27 (FIGS. 1-3) on the interior or exterior of the column 15 to thread over the bolt 26 to attach the side plate 21 to the column can be used because fabricators can access both ends of the bolts to insert the bolts into the bolt holes 26A and thread the nuts on to the bolts. In the illustrated embodiment, the nuts 27 are disposed on the exterior of the joint connection. However, the nuts could be threaded onto the bolts on the interior of the column 15. In conventional hollow column constructions, specialized bolts (e.g., blind blots) must be used because only the exterior of the column is readily accessible to the fabricators. Therefore, the configuration of the current joint connection facilities the use of standard bolts 26 to connect the gusset plates 21 to the column 15.

Figure 5:
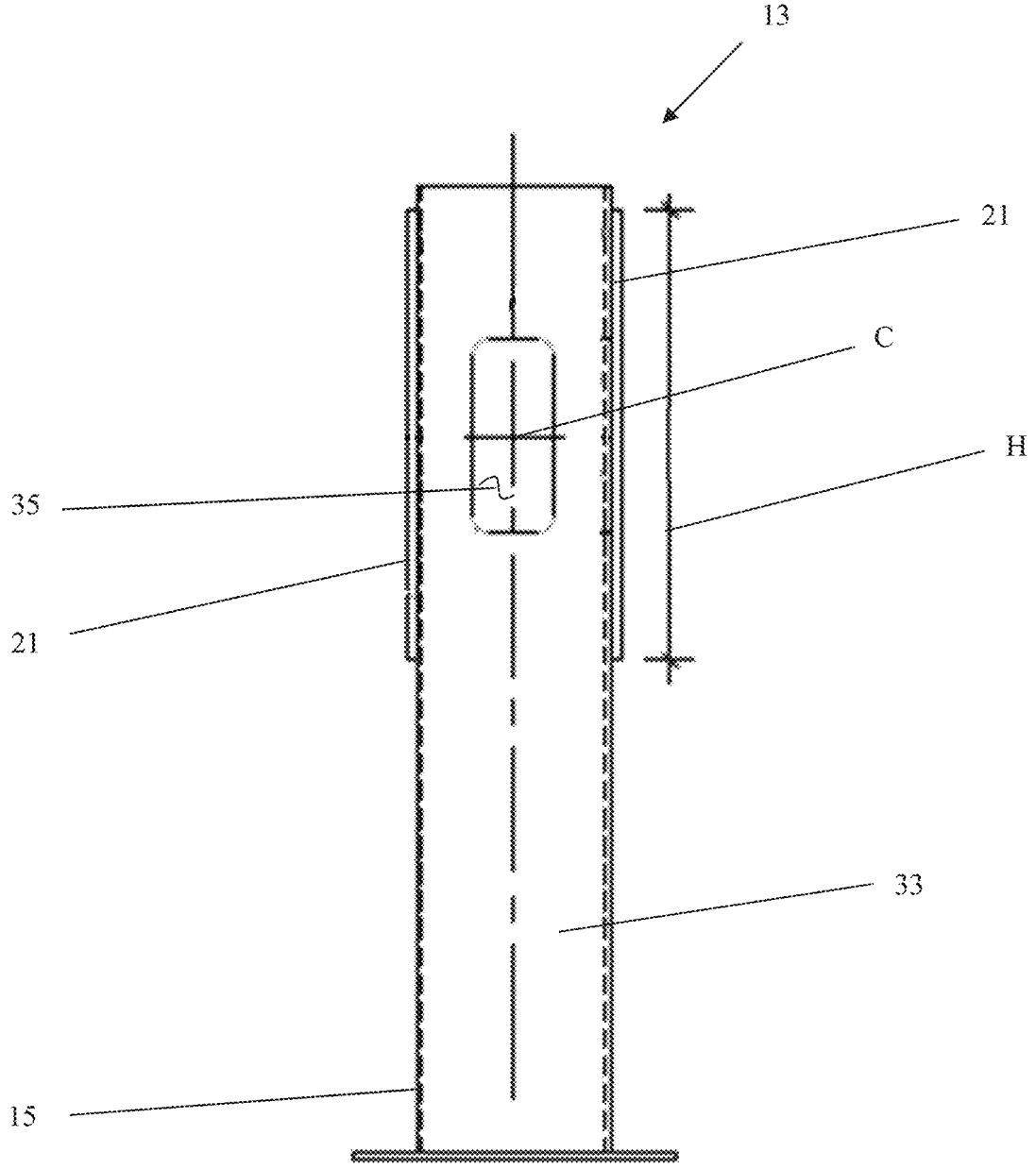
FIG. 5 is a right side view of the column assembly of FIG. 4.
Figure 6:
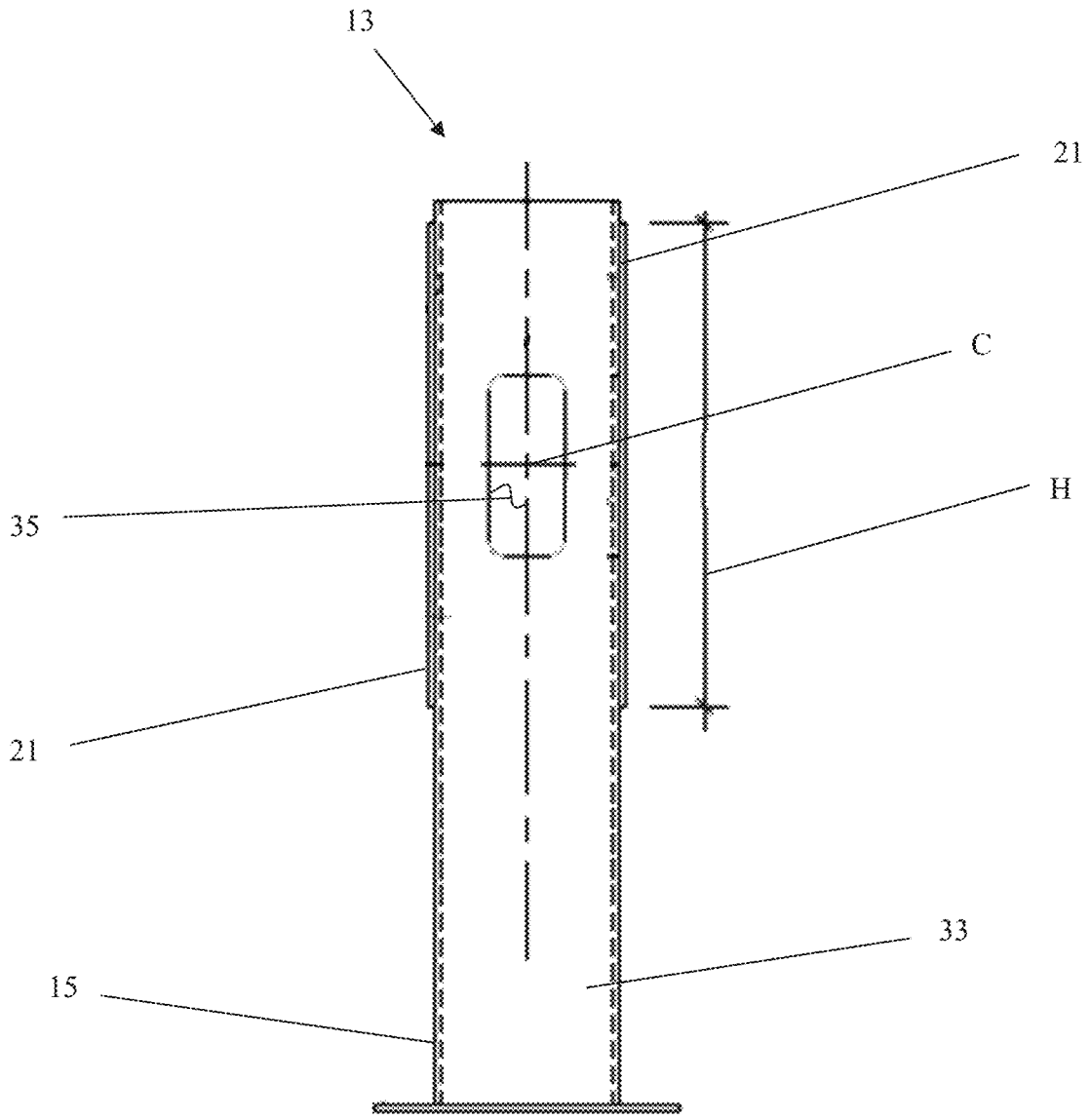
FIG. 6 is a left side view of the column assembly of FIG. 4.

Referring to FIGS. 2, 5, and 6, the openings 35 are located at a location on the column 15 that is disposed between the side plates 21 when the side plates are bolted to the column 15. The side plates 21 transfer loads from the beam 19 directly to the first side walls 31. Therefore, the openings 35 located in the second side walls 33 are within the areas of relatively low stress in the joint connection. Thus, the openings 35 will provide access to the interior of the column 15 by removing material of the column without materially degrading the strength of the joint connection. In one embodiment, a center C (FIGS. 5 and 6) of the openings 35 is located at mid height of the opposing side plates 21. Alternatively, the opening 35 can be centered at other locations depending on the load path across the side walls 33 of the column 15.

In the illustrated embodiment, the openings 35 remain open after the side plates 21 are bolted to the column 15. However, the openings 35 can be closed after the side plates 21 are attached to the column using the material of the column 15 removed to form the openings. Alternatively, a separate piece of material may be used to cover the opening 35 after the side plate plates 21 are attached. Additionally or alternatively, a gravity framing member (not shown) may frame into or across the opening 35. It will be understood that closing the openings 35 is not always structurally required for adequate joint connection performance. Thus, one or both of the openings 35 may remain open.

Figure 7:
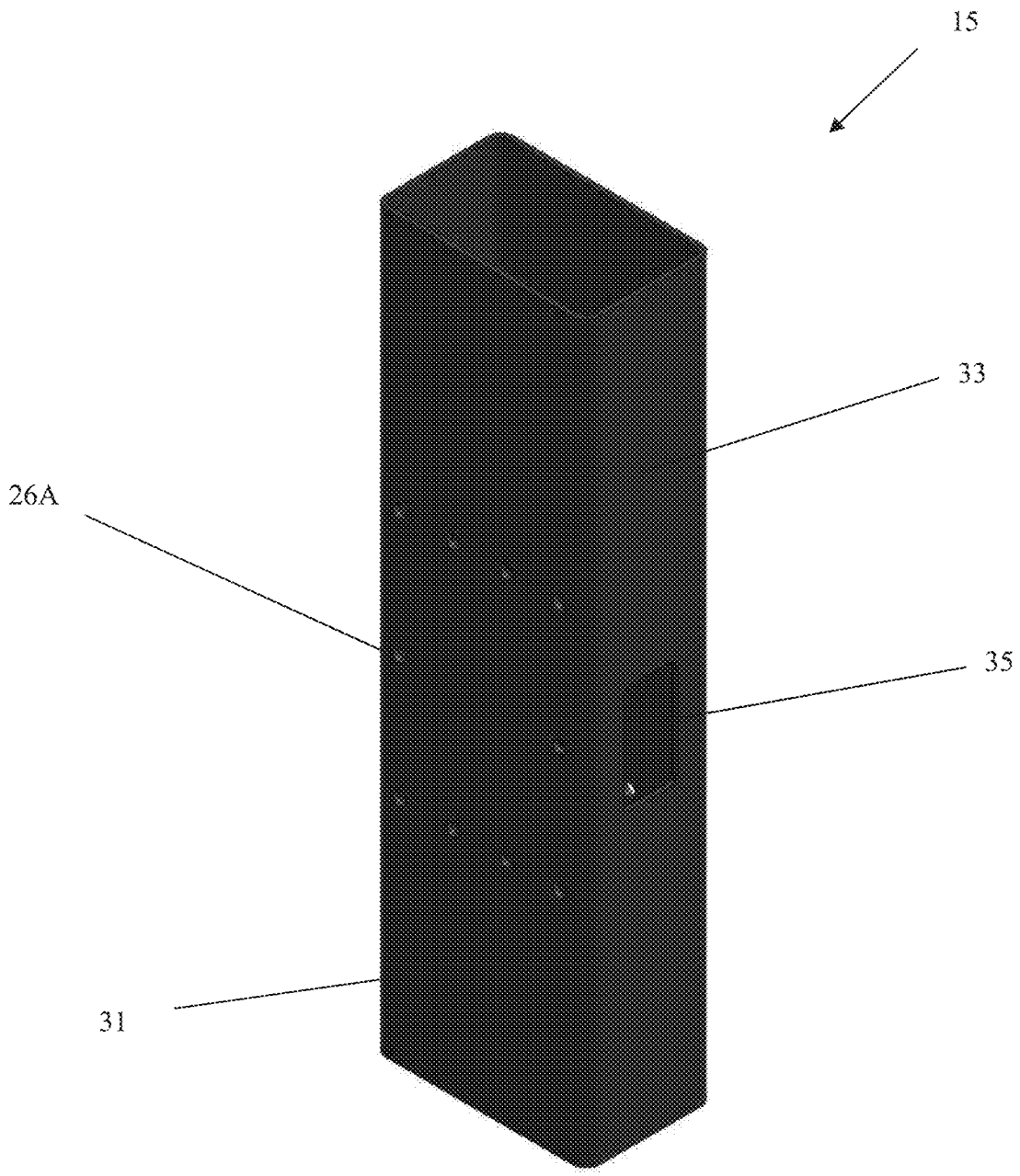
FIG. 7 is a perspective of a column of the column assembly of FIG. 4.
Figure 7A:
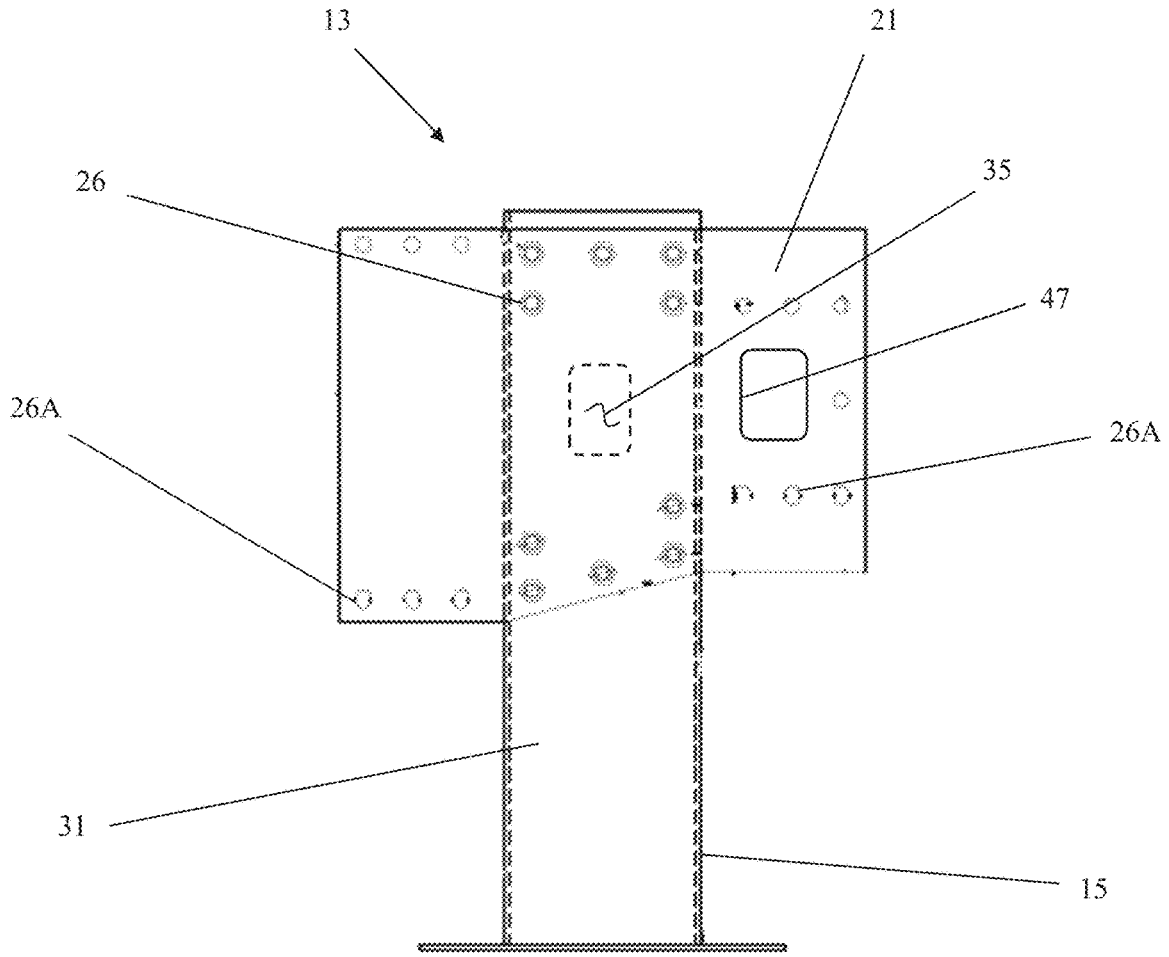
FIG. 7A is a front view of the column assembly of the beam-to-column-to-beam joint connection structure of FIG. 1 showing an alternative opening configuration.

While the illustrated embodiment shows the openings 35 being formed in the beam facing side walls 33, it is further envisioned that openings 36 could additionally or alternatively be formed in one or both of the side walls 31 that engage the side plates 21 (FIG. 7A). In this embodiment, the openings 36 can be located at about mid-height of the side plates 21. In particular, the openings 36 could be in the space within the bolt holes 26A in the side walls 31 of the column 15. Additionally or alternatively, an opening 37 (FIG. 1) can be formed within the confines of beam 20 (i.e., between the upper and lower flanges of beam 20) when the side plates 21 are positioned for attachment to the column 15 and beam 20. In these instances, it is understood that the openings 36, 37 will be located in areas of relatively high stress within the joint connection. Therefore, the openings 36, 37 will be uniquely sized, positioned, and oriented to account for the load path across the side plates 21 and side walls 31 of the column 15. Moreover, the column 15 and/or side plates 21 can be sized and shaped to withstand the stress. The openings 36, 37 may remain open or be closed after the side plates 21 are attached.

Referring to FIGS. 3 and 8-11, the HSS beam 19 includes a hollow beam having open longitudinal ends. However, the longitudinal ends could be closed. In the illustrated embodiment, the beam 19 has a rectangular cross sectional shape defined by four side walls extending along a length of the beam, but could also be other shapes. A first pair of opposing side walls 41 extend across the major (i.e., larger) dimension of the beam 19. The first pair of side walls 41 are configured for engagement with respective side plates 21 when the side plates are bolted to the beam 19. In one embodiment, the side plates 21 extend along substantially an entire height of the first side walls 41. A second pair of opposing side walls 43 extend between the first pair or side walls 41 and define the minor (i.e., smaller) dimension of the beam. The second pair of side walls 43 define the top and bottom of the beam 19 when the beam is bolted to the column assembly 13. It will be understood that the beam 19 could have a square cross-sectional shape such that the first side walls 41 and second side walls 43 have the same lateral dimension. Additionally, the second side walls 43 could have a larger lateral dimension than the first side walls 41.

As discussed above, the side plates 21 reinforce the column 15 and beams 19, 20. With respect to the beams 19, 20, the side plates 21 cause the stresses on the joint connection to be transferred to sides of the joint along the side plates 21 away from the column facing end and top and bottom of the beams 19, 20. Thus, the ends, top and bottom of the beams 19, 20 between the side plates 21 also constitute areas of relatively low stress within the joint connection.

Figure 8:
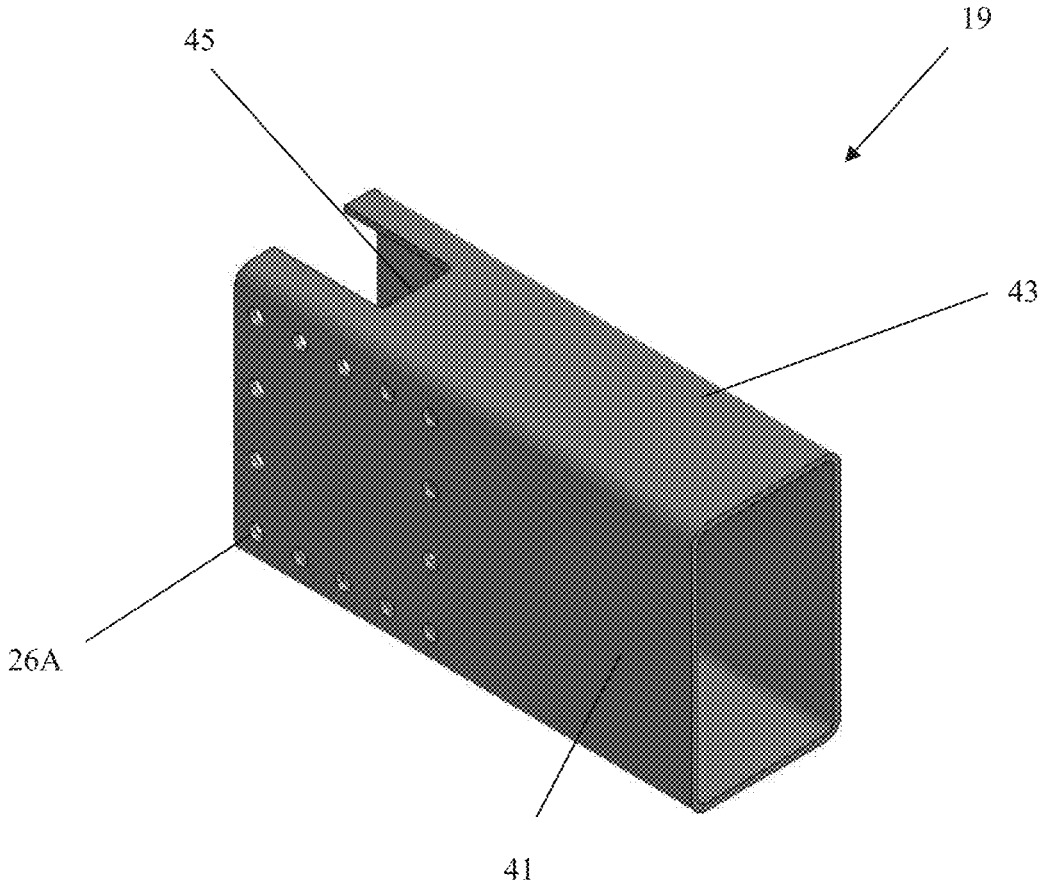
FIG. 8 is a fragmentary perspective of a beam on the right side of the beam-to-column-to-beam joint connection structure of FIG. 1.
Figure 9:
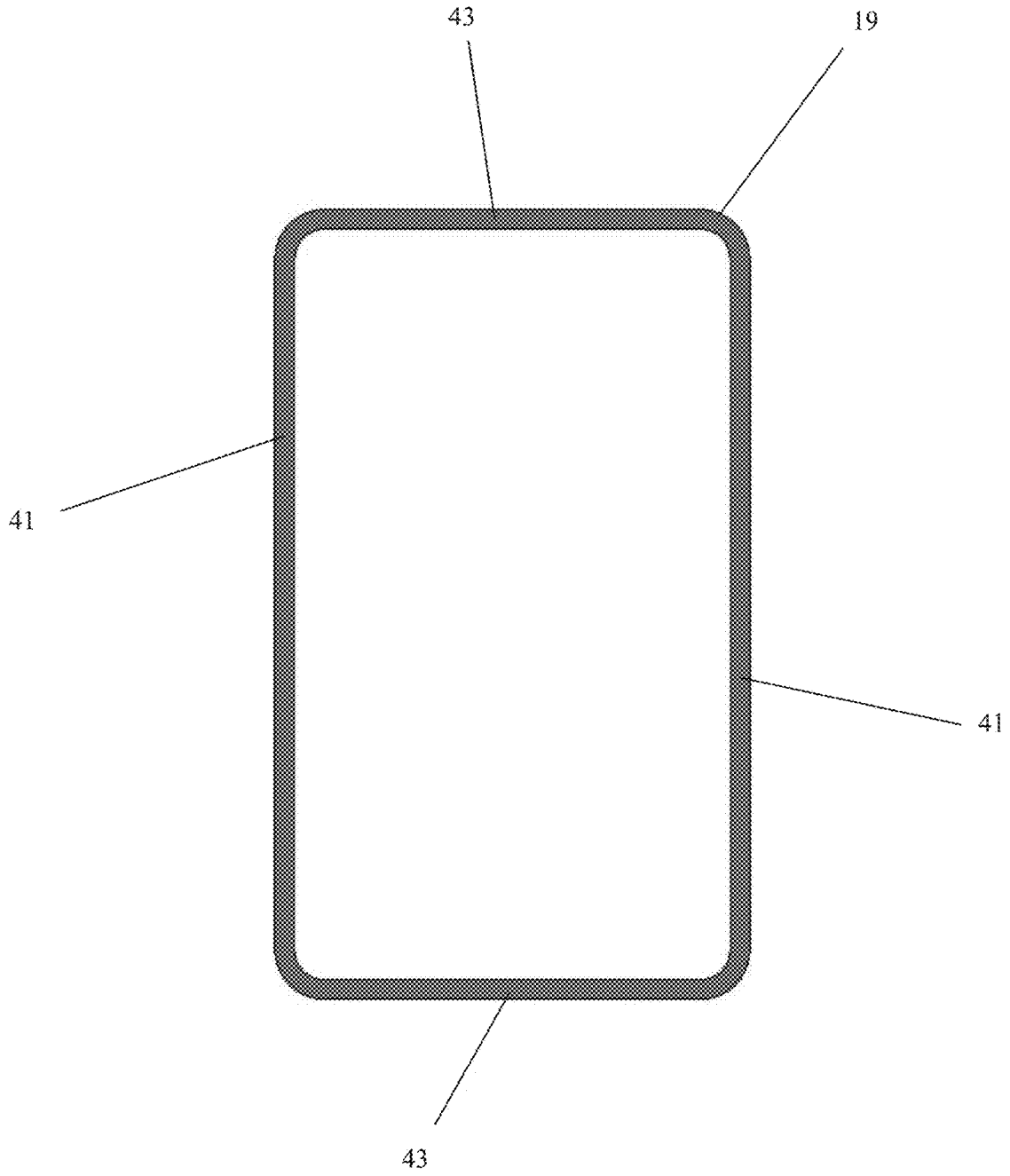
FIG. 9 is an end view of the beam of FIG. 8.
Figure 10:
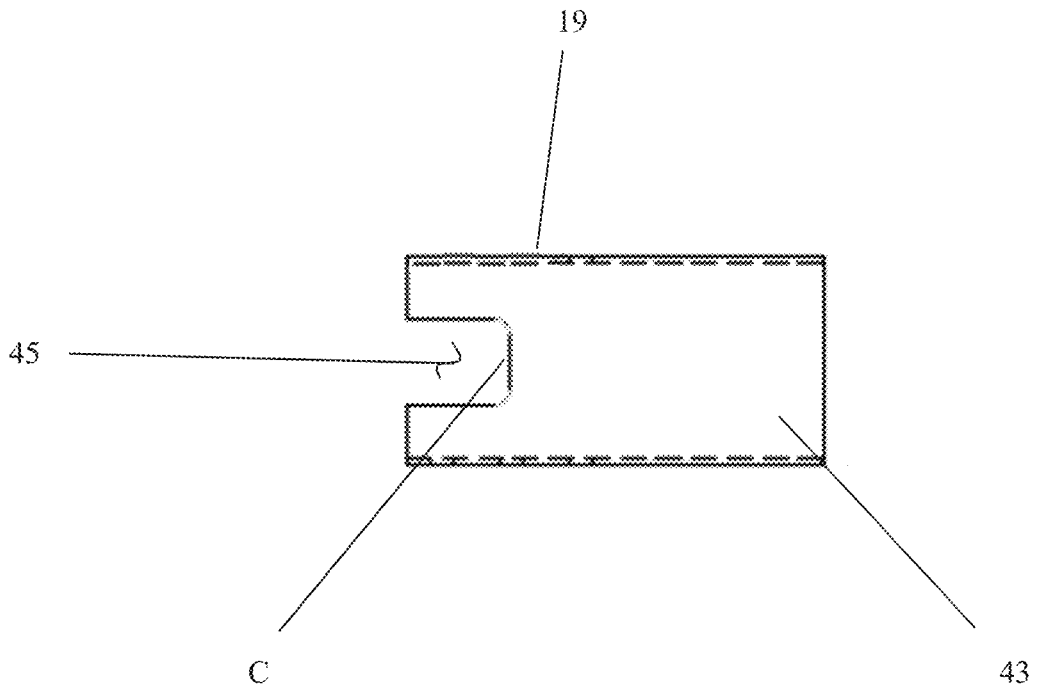
FIG. 10 is a top view of the beam similar to the beam of FIG. 8.

Referring to FIGS. 8 and 9, at least one of the second pair of side walls 43 includes an opening or cut out 45. In the illustrated embodiment, openings 45 are formed in both of the second pair of side walls 43. However, only one of the side walls 43 may have the opening 45, or the openings can be omitted. The openings 45 extend from a longitudinal end of the beam 19 such that they have an open end adjacent the column 15 and a closed end opposite the open end. The openings 45 have a generally rectangular shape with the closed end having rounded corners. The openings 45 extend along the length of the beam 19 such that a longitudinal axis of each opening extends generally parallel to the length of the beam. However, the openings 45 could have other shapes and orientations without departing from the scope of the disclosure. For example, the closed end of the openings 45 may have square corners or the openings may be square or circular in shape. Additionally, the openings 45 may extend in other directions along the surface of the side walls 43 and/or may be located at other positions on the side walls. For instance, the openings 45 may be inset from the end of the beam 19 such that both ends of the opening are closed. The openings 45 provide access to fabricators to the interior of the beam 19 so that standard bolts 26 can be used to attach the side plates 21 to the beam. In particular, bolts 26 that require a separate nut 27 (FIGS. 1-3) on the interior or exterior of the beam 19 to thread over the bolt 26 to attach the side plate 21 to the beam can be used because fabricators can access both ends the bolts to thread the nuts on to the bolts. In conventional hollow beam constructions, specialized bolts (e.g., blind bolts) must be used because only the exterior of the beam is readily accessible to the fabricators. Therefore, the configuration of the current joint connection facilities the use of standard bolts 26 to connect the gusset plates 21 to the beam 19.

Referring to FIG. 3, the openings 45 are located at a position on the beam 19 that is disposed between the side plates 21 when the side plates are bolted to the beam. Therefore, the openings 45 are located within the areas of relatively low stress in the joint connection. Thus, the openings 45 will provide access to the interior of the beam 19 by removing material of the beam without materially degrading the strength of the joint connection. In one embodiment, a center C (FIG. 10) of the openings 45 is located midway between the opposing side plates 21 when the side plates are attached to the beam 19. Alternatively, the openings 45 can be centered at other locations depending on the load path across the side walls 43 of the beam 19.

In the illustrated embodiment, the openings 45 remain open after the side plates 21 are bolted to the beam 19. However, the openings 45 can be closed after the side plates 21 are attached to the beam 19 using the material of the beam removed to form the openings. Alternatively, a separate piece of material may be used to cover the openings 45 after the side plates 21 are attached. Additionally, openings 37 in the side plates 21 can be closed after the side plates are attached to beam 20. It will be understood that closing the openings 37, 45 is not always structurally required for adequate joint connection performance. Thus, some or all of the openings 37, 45 may remain open.

Figure 11:
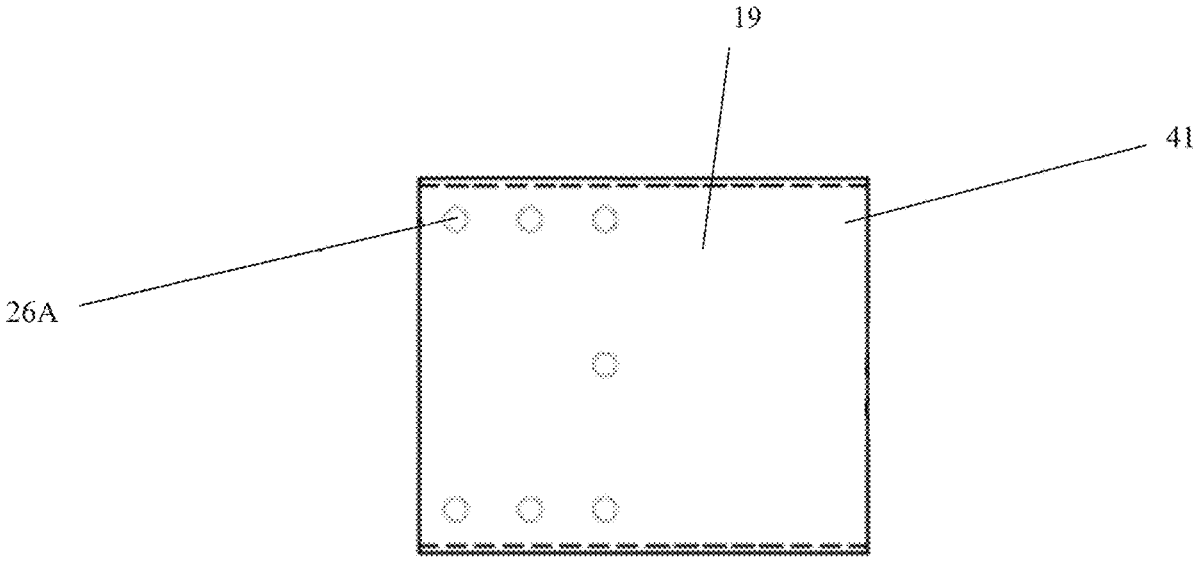
FIG. 11 is a front view of the beam of FIG. 10.
Figure 11A:
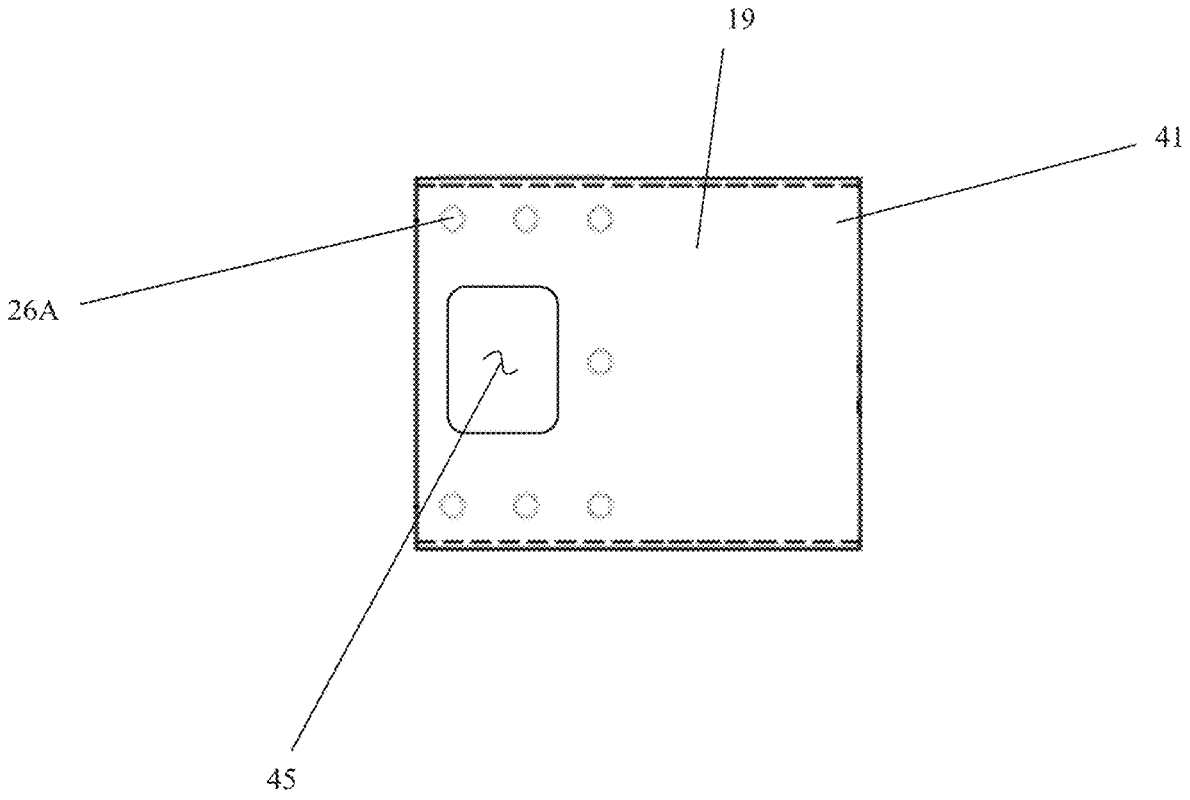
FIG. 11A is a front view of the beam of FIG. 10 showing an alternative opening configuration.
Figure 12:
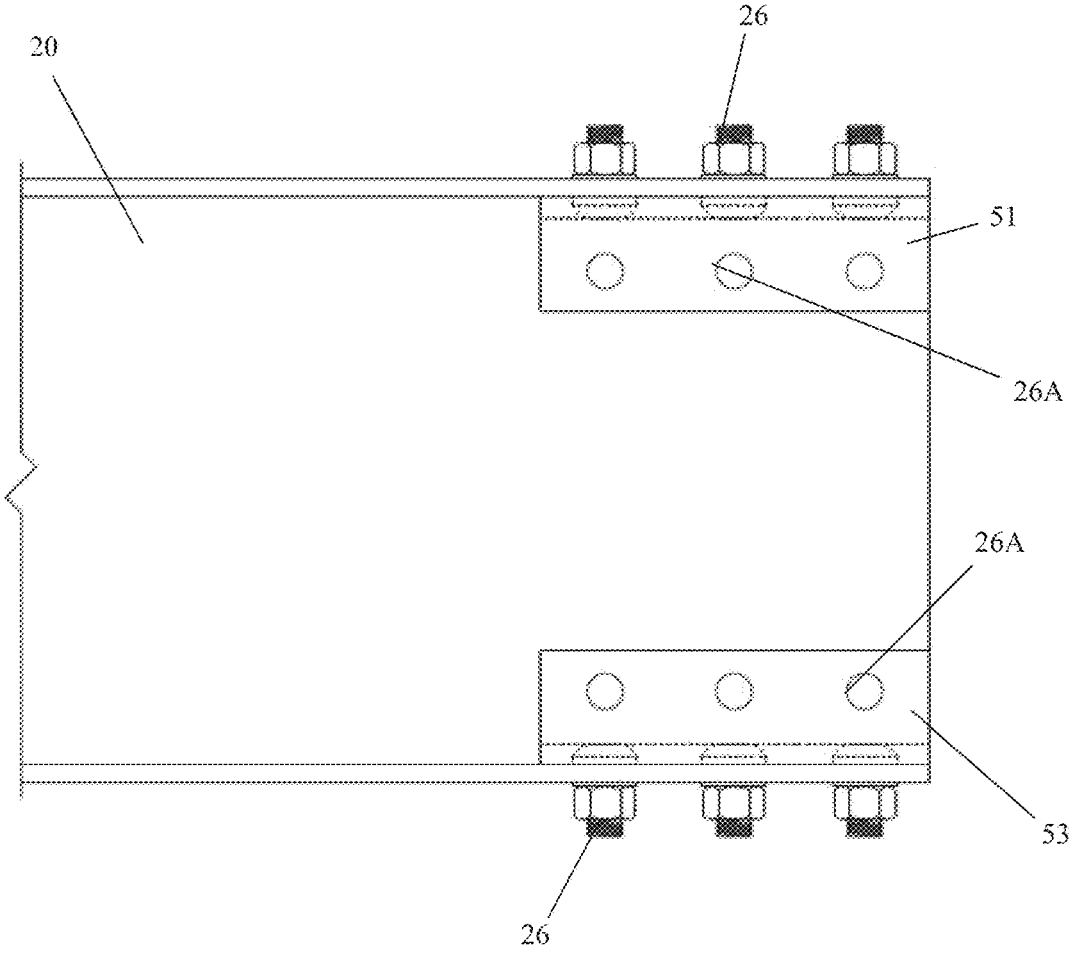
FIG. 12 is a front view of a beam assembly on the left side of the beam-to column-to-beam joint connection structure of FIG. 1.
Figure 13:
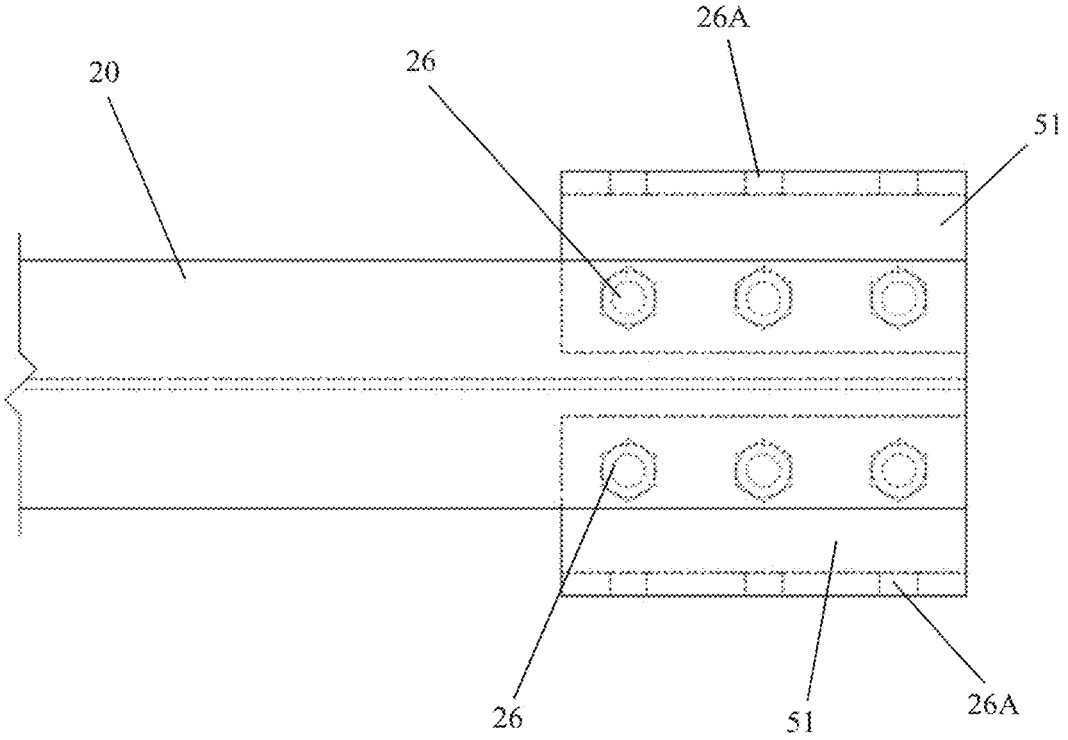
FIG. 13 is a top view of the beam assembly of FIG. 12.
Figure 14:
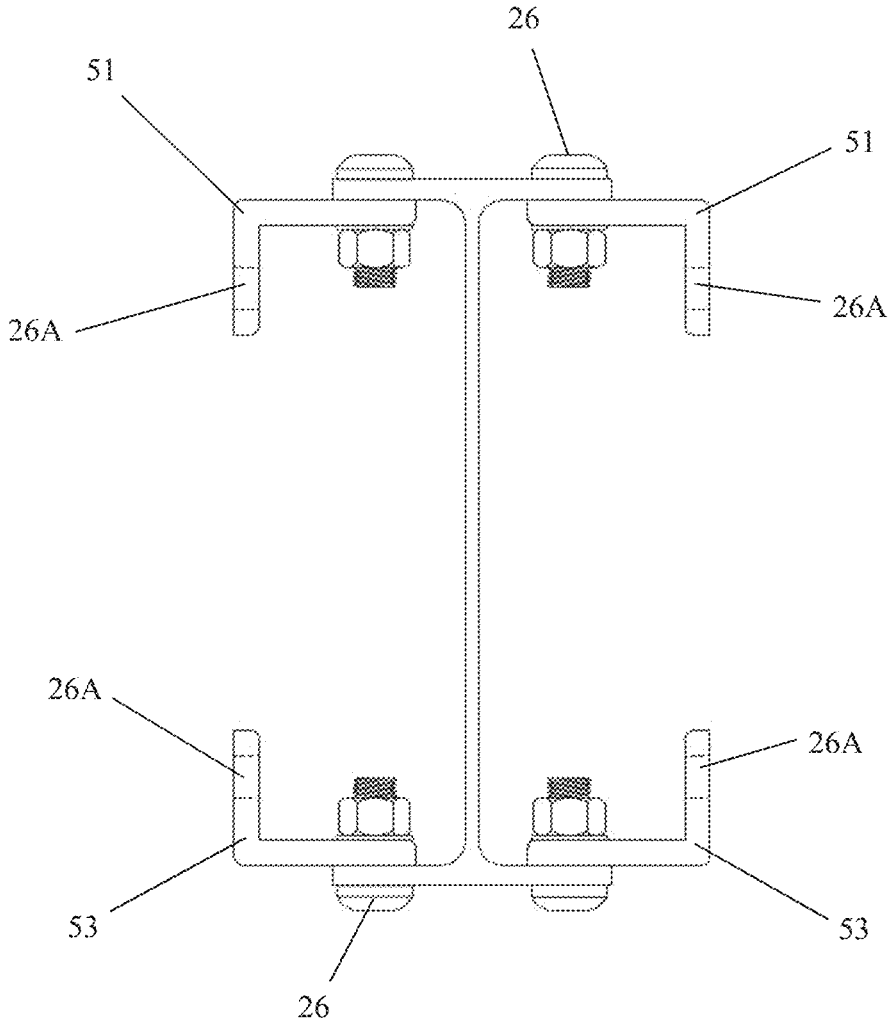
FIG. 14 is an end view of the beam assembly of FIG. 12.

While the illustrated embodiment shows the openings 45 being formed in the top and bottom side walls 43, it is further envisioned that the openings could additionally or alternatively be formed in one or both of the side walls 41 that engage the side plates 21 (FIG. 11A). In this embodiment, the openings 45 can be located at about mid-height of the side plates 21. In this instance, it is understood that the openings 45 will be located in areas of relatively high stress within the joint connection. Therefore, the openings 45 will be uniquely sized, positioned, and oriented to account for the load path across the side walls 41 of the beams 19, 20. The beams 19, 20 and side plates 21 may also be sized and shaped to withstand the additional stress. The openings 45 in the side walls 41 may remain open or be closed after the side plates 21 are attached. Additionally, openings 47 (FIG. 7A) could be formed in the side plates 21 that align or at least partially align with the openings 45 in the side walls 41 of the beam 19 or as needed for beam 20.

Referring to FIGS. 1, 3, and 12-14, beam 20 on the opposite side of the column 15 is bolted to the side plates 21 using angle irons. Upper angle irons 51 are attached to a bottom surface of the top flange of the full-length beam 20. The upper angle irons 51 may comprise elongate L-shaped members including a horizontal first leg attached to the bottom surface of the top flange of the beam 20 at opposite side portions of the beam and extending horizontally along the side portions. The first leg of each upper angle iron 51 is attached in a suitable manner such as by bolts 26 to the bottom surface of the top flange of the beam 20. Each upper angle iron 51 may also include a second leg projecting from the first leg of the upper angle iron and downward, toward the bottom flange of the beam 20. In the illustrated embodiment, the first and second legs of each upper angle iron 51 are disposed at substantially a right angle to each other. An outer surface of the vertical second leg of each upper angle iron 51 is bolted to an inner surface of a respective side plate 21 by horizontally spaced bolts 26 extending through aligned bolt holes 26A in the second leg of the upper angle iron and the side plate 21. In the illustrated embodiment, the upper angle irons 51 are configured such that the horizontal first legs extend laterally past the lateral edges of the top flange of the beam 20 so the outer surfaces of the vertical second legs are disposed laterally away from the flange tips of the top flange of the beam 20. The upper angle irons 51 may be otherwise configured and/or arranged within the scope of the present invention. Additionally, although angle irons 51 are illustrated, other forms of connecting members may be used.

Lower angle irons 53 are attached to a top surface of the bottom flange of the full-length beam 20. The lower angle irons 53 may comprise elongate L-shaped members including a horizontal first leg attached to the top surface of the bottom flange of the beam 20 at opposite side portions of the beam and extending horizontally along the side portions. The first leg of each lower angle iron 53 is attached in a suitable manner such as by bolts 26 to the top surface of the bottom flange of the beam 20. Each lower angle iron 53 may also include a second leg projecting from the first leg of the lower angle iron and upwards, toward the upper flange of the beam 20. In the illustrated embodiment, the first and second legs of each lower angle iron 53 are disposed at substantially a right angle to each other. An outer surface of the vertical second leg of each lower angle iron 53 is bolted to an inner surface of a respective side plate 21 by horizontally spaced bolts 26 extending through aligned bolt holes 26A in the second leg of the lower angle iron and the side plate 21. In the illustrated embodiment, the lower angle irons 53 are configured such that the horizontal first legs extend laterally past the lateral edges of the bottom flange of the beam 20 so the outer surfaces of the vertical second legs are disposed laterally away from the flange tips of the bottom flange of the beam 20. The lower angle irons 53 may be otherwise configured and/or arranged within the scope of the present invention. Additionally, although angle irons 53 are illustrated, other forms of connecting members may be used.

The joint connection structure 11 described above is a beam-to-column-to-beam type structure. It will be understood by a person having ordinary skill in the art that a beam-to-column type structure will have analogous components. Most preferably, each of the components of the joint connection structure 11, as well as the beams 19, 20 and column 15, are made of structural steel. Some of the components of the joint connection structure 11 may be united by welding and some by bolting. The welding may be initially performed at a fabrication shop. The bolting may be performed at the fabrication shop and/or at the construction site, or a combination of the two, which may be a preferred option in many regions of the world.

Figure 15:
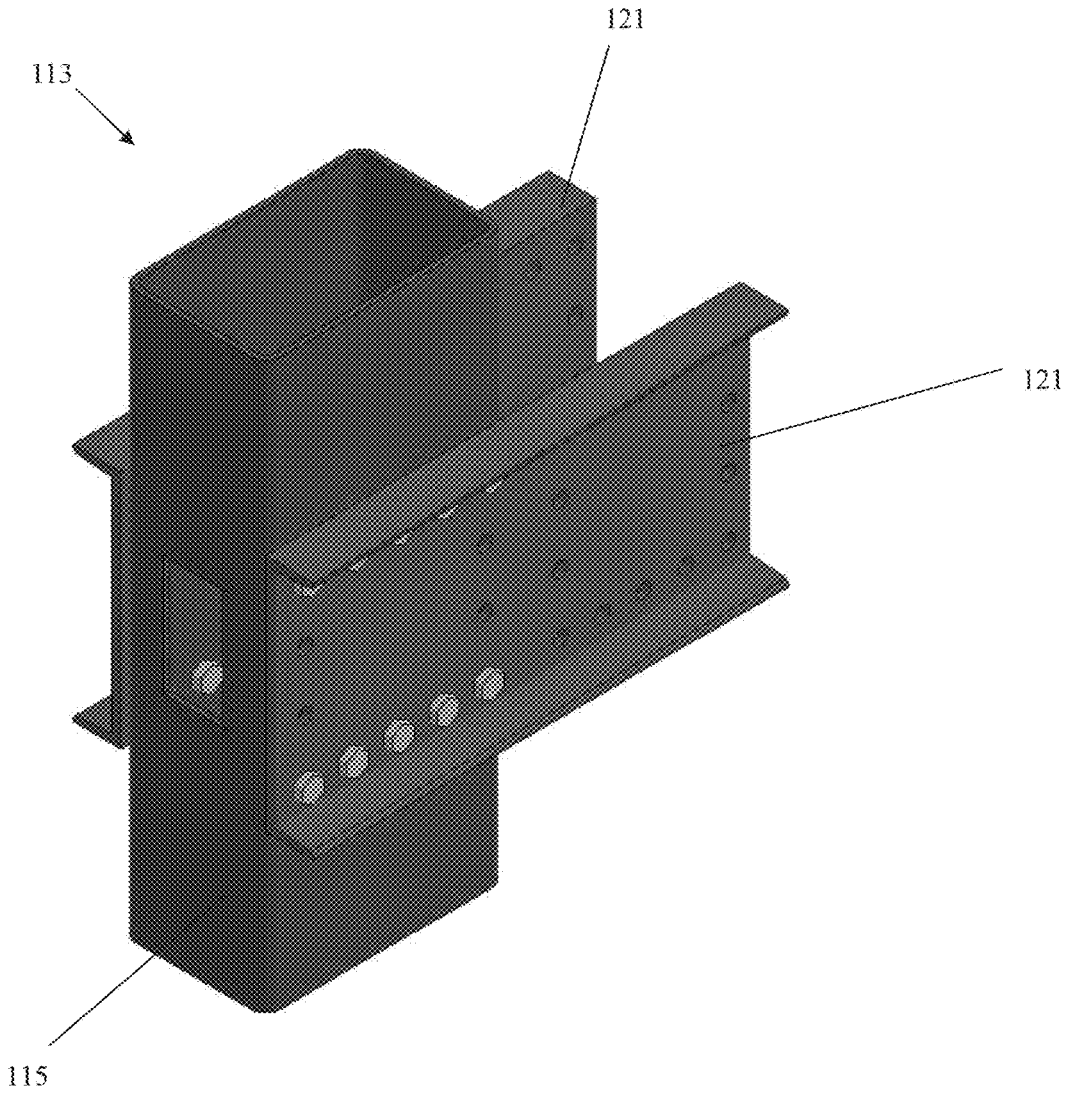
FIG. 15 is a perspective of another embodiment of a column assembly.

Referring to FIG. 15 a column assembly of another embodiment is generally indicated at 113. The column assembly 113 includes a column 115 and a pair of side plates 121 bolted to the column. The column assembly 113 is substantially similar to a portion of the column assembly 13 of first embodiment except the side plates 121 comprise channel-shaped plates and extend laterally from only one side of the column 115.

Figure 16:
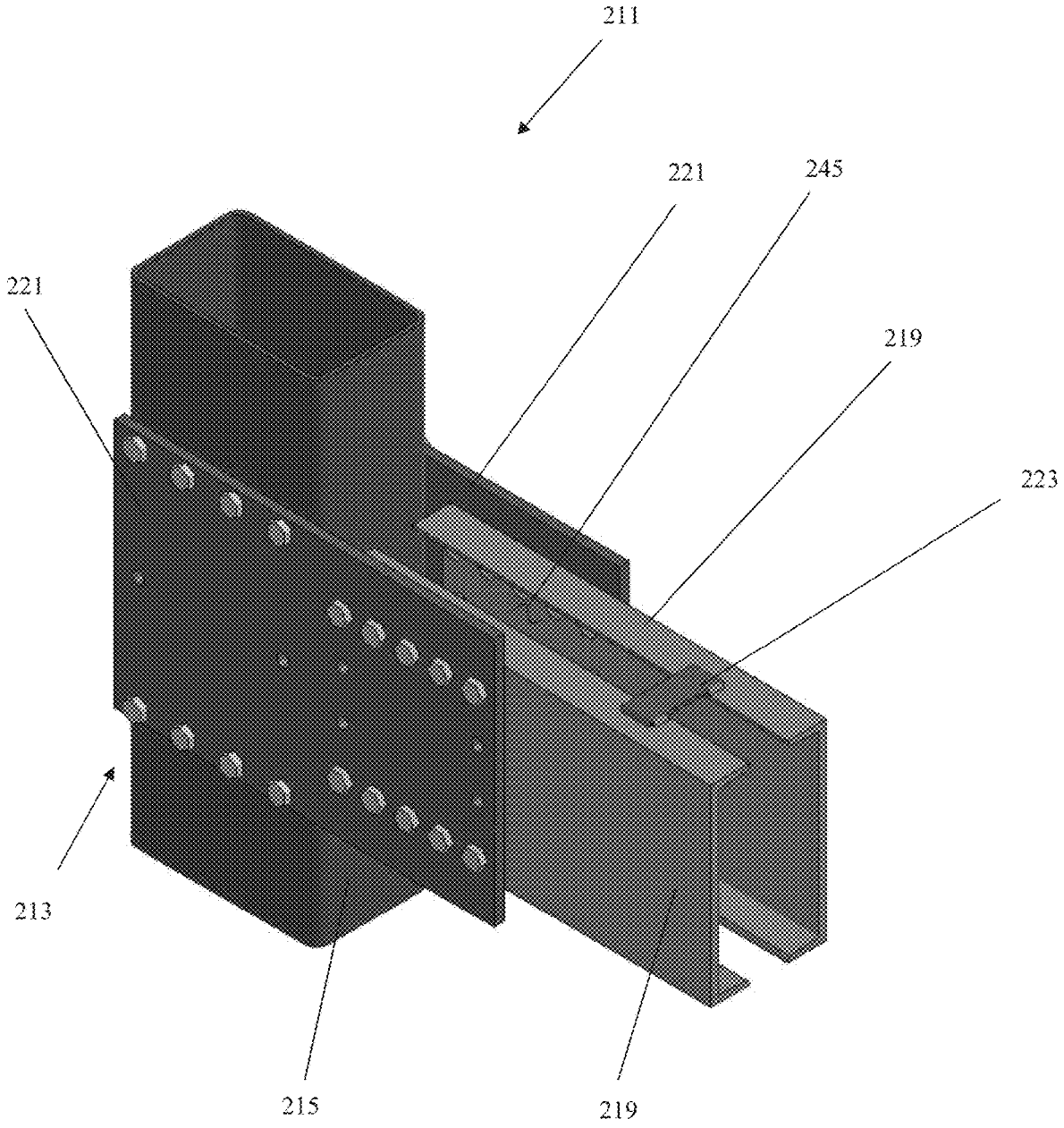
FIG. 16 is a perspective of another embodiment of a beam-to-column joint connection structure.
Figure 17:
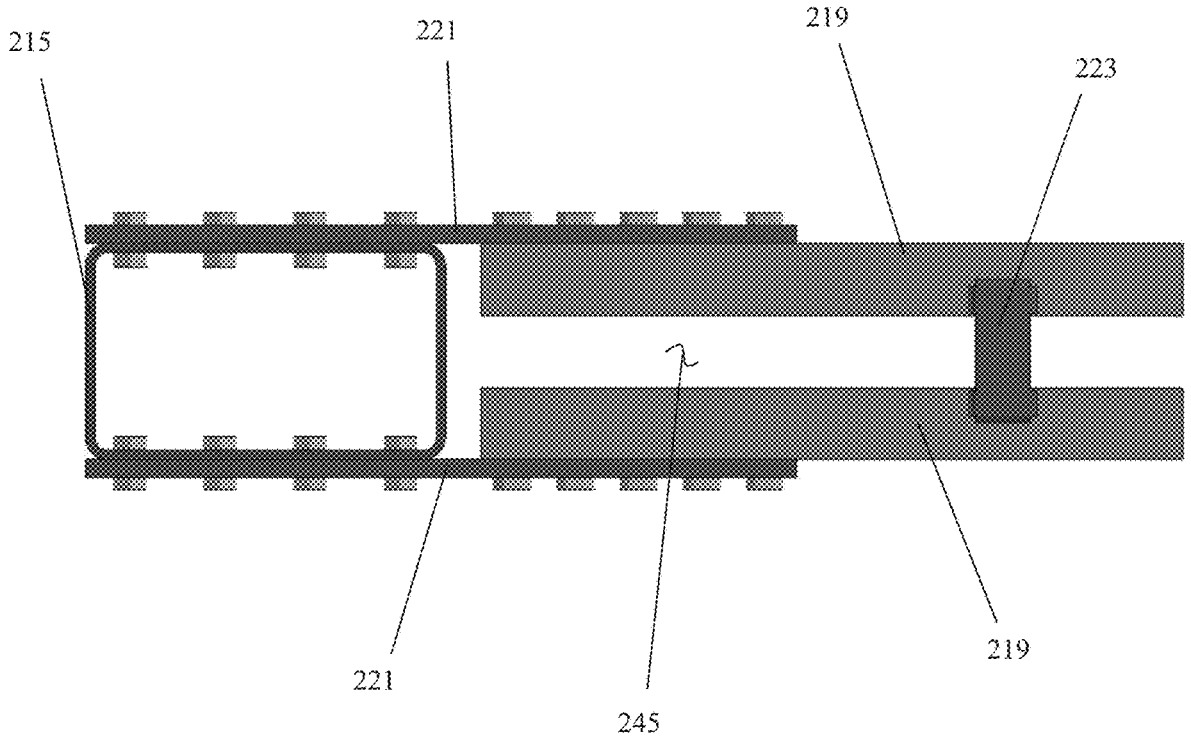
FIG. 17 is a top view of the beam-to-column joint connection structure of FIG. 16.
Figure 18:
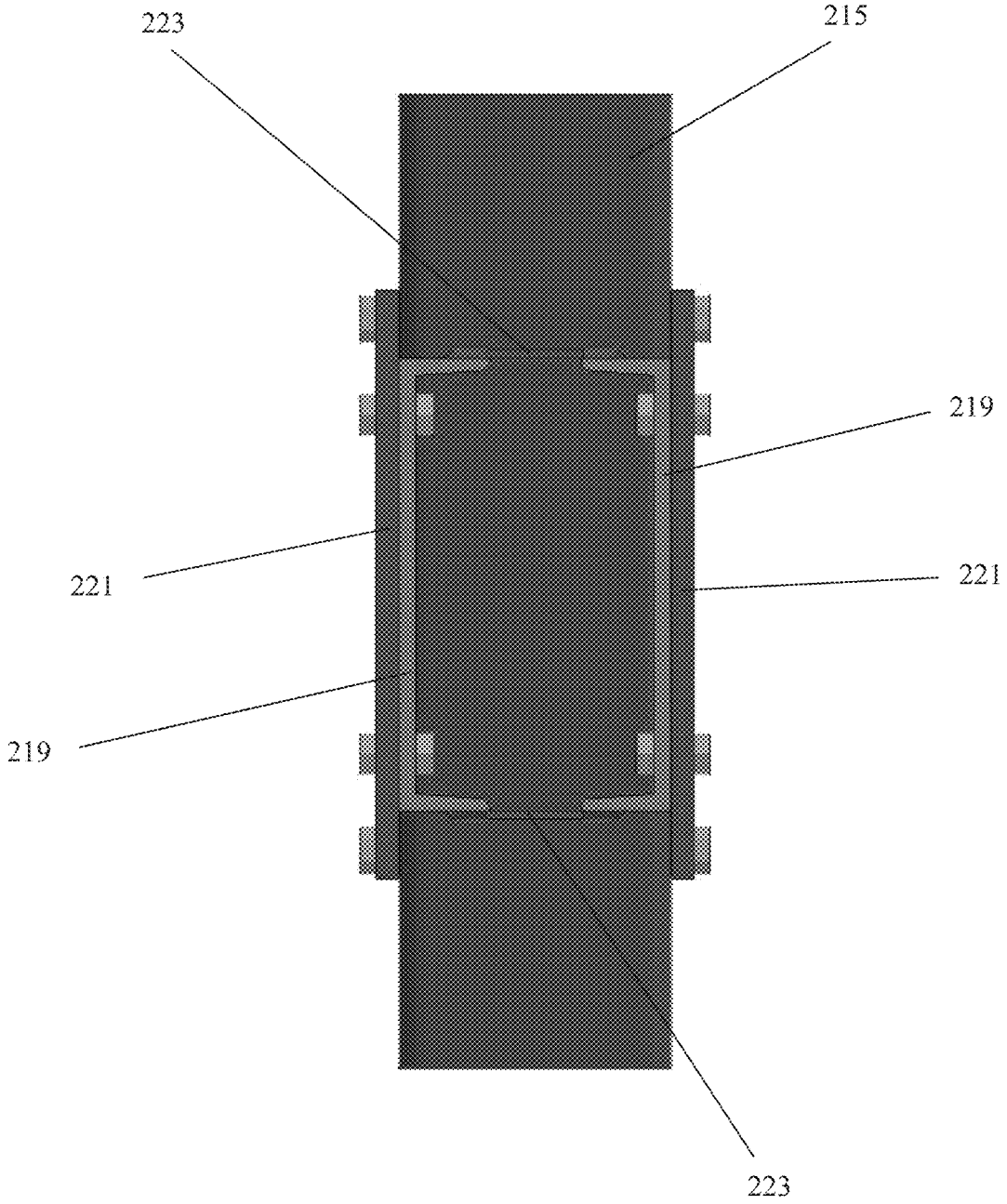
FIG. 18 is a side view of the beam-to-column joint connection structure of FIG. 16.

Referring to FIGS. 16-18 a beam-to-column moment-resisting joint connection structure of another embodiment is generally indicated at 211. The joint connection structure may be used in the construction of a building framework. In the illustrated embodiment, the joint connection joins a column assembly 213, including a column 215 and side plates 221, to a full-length beam assembly 217 including a pair of full-length beam channels 219 attached together by a beam tie 223. It will be understood that more than one beam tie (not shown) may be used within the scope of the present invention. In the illustrated embodiment, the column 215 is a hollow rectangular column. However, the column could have other configurations, such an I-beam, H-beam, or circular shape, without departing from the scope of the disclosure. The joint connection structure is substantially similar to a portion of the first embodiment except beam 19 is replaced with the beam channels 219 and tie 223. A gap 245 between the beam channels 219 provides access for bolting the side plates 221 to the beam channels.

It will be understood that the specific connections described in each of the embodiments are interchangeable.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

Moment resisting column-to-beam joint connection structures, column assemblies and beam assemblies that are constructed according to the principles of the present invention provide numerous unique features, benefits and advantages. Reference is made to the figures illustrating some of the embodiments to which the advantages and benefits apply.

OTHER STATEMENTS OF THE INVENTION

A1. A method of constructing a column assembly comprising:

providing a column including a first pair of opposing side walls and a second pair of opposing side walls extending between the first pair of opposing side walls;

forming a plurality of bolt holes in the first pair of opposing side walls;

forming an opening separate from the bolt holes in one of the first and second pairs of opposing side walls;

bolting side plates to the first pair of opposing side walls by accessing bolts extending through the bolt holes through the opening in one of the first and second pairs of opposing side walls.

A2. The method of claim A1, further comprising covering the opening in one of the first and second pairs of opposing side walls after the side plates are attached to the column.

A3. The method of claim A1, further comprising forming a second opening separate from the bolt holes in another of the first and second pairs of opposing side walls.

A4. The method of claim A1, further comprising attaching a beam assembly to the column assembly.

A5. The method of claim A4, wherein attaching the beam assembly comprises:

providing a beam including a top surface, a bottom surface, and a pair of side surfaces extending between the top and bottom surfaces;

forming a plurality of bolt holes in each of the side surfaces;

forming an opening separate from the plurality of bolt holes in the side surfaces in one of the top surface and bottom surface; and bolting the side plates to the side surfaces by accessing bolts extending through the bolt holes in the side surfaces through the opening in one of the top surface and bottom surface.

A6. The method of claim A5, further comprising covering the opening in one of the top surface and bottom surface after the side plates are attached to the beam.

What is claimed:

1. A column assembly comprising:

a hollow structural section (HSS) column; and a pair of side plates bolted to the HSS column on opposite sides of the HSS column and extending laterally outward from the HSS column such that the side plates extend past side edges of the HSS column, the HSS column defining an opening disposed between the side plates providing access to an interior of the HSS column for bolting the side plates to the HSS column, the opening being free of a fastener attaching one of the side plates to the HSS column.

2. The column assembly of claim 1, further comprising a bolt extending through aligned bolt holes in the side plates and column, and separate nuts securing the bolts in the bolt holes, the side plates comprising planar plate members.

3. The column assembly of claim 1, wherein the column includes a first pair of opposing side walls engaging respective side plates, and a second pair of opposing side walls extending between the first pair of side wall, the opening being disposed in one of the second pair of side walls.

4. The column assembly of claim 1, wherein the opening has a center disposed at about mid-height of the side plates.

5. The column assembly of claim 1, wherein the column includes a first pair of opposing side walls engaging respective side plates, and a second pair of opposing side walls extending between the first pair of side wall, the opening being disposed in one of the first pair of side walls.

6. The column assembly of claim 5, further comprising an opening in at least one of the side plates.

7. A beam for attachment to a column assembly comprising:

a beam including an upwardly facing surface, a downwardly facing surface, and a pair of side surfaces extending between the upwardly facing and downwardly facing surfaces;

a plurality of bolt holes in each of the side surfaces for receiving bolts to attach side plates of the column assembly to the beam; and an opening disposed in one of the upwardly facing surface and downwardly facing surface, the opening being free of a fastener;

wherein the beam comprises a hollow structural section (HSS) beam including an open longitudinal end, the opening extending directly from the open longitudinal end such that the opening is defined in part by a cut out in one of the upwardly facing and downwardly facing surfaces of the beam whereby one of the upwardly facing and downwardly facing surfaces extends longitudinally along the opening, and wherein the opening comprises a first opening, a second opening being disposed in the other of the upwardly facing surface and downwardly facing surface, the second opening extending directly from the open longitudinal end such that the second opening is defined in part by a cut out in the other of the upwardly facing and downwardly facing surfaces of the beam whereby the other of the upwardly facing and downwardly facing surfaces extends longitudinally along the second opening.

8. A joint connection structure of a building framework comprising:

a column assembly including a hollow structural section (HSS) column and a pair of side plates attached to the HSS column on opposite sides of the HSS column and extending laterally outward from the HSS column such that the side plates extend past side edges of the HSS column; and a beam assembly configured to be attached to the side plates of the column assembly, the beam assembly including a beam having an end portion proximate the side plates, the HSS column having an opening in an area between the side plates to provide access for bolting at least one of the side plates to the HSS column, the opening being free of a fastener extending through the opening when the column assembly is attached to the beam assembly.

9. The joint connection structure of claim 8, wherein an entirety of the opening is between the side plates such that a top of the opening is located below tops of the side plates, and a bottom of the opening is located between bottoms of the side plates.

10. The joint connection structure of claim 8, wherein the beam assembly is directly attached to the side plates.

11. The joint connection structure of claim 8, wherein the column has a pair of side plate engagement surfaces, the opening being disposed in one of the side plate engagement surfaces.

12. The joint connection structure of claim 11, wherein the opening comprises a first opening, a second opening be disposed in the other of the side plate engagement surfaces.

13. The joint connection structure of claim 8, wherein the column has a beam facing surface, the opening being disposed in the beam facing surface of the column.

14. The joint connection structure of claim 13, wherein the opening has a center disposed at about mid-height of the side plates.

15. The joint connection structure of claim 13, wherein the side plates are bolted to the column.

16. The joint connection structure of claim 8, wherein the beam has an upwardly facing surface and a downwardly facing surface, a second opening being disposed in one of the upwardly facing surface and downwardly facing surface of the beam.

17. The joint connection structure of claim 16, wherein the beam comprises a HSS beam.

18. The joint connection structure of claim 16, wherein the second opening has a center disposed about midway between the side plates.

19. The joint connection structure of claim 18, wherein the beam has an open longitudinal end, the second opening extending directly from the open longitudinal end such that the second opening is defined in part by a cut out in one of the upwardly facing and downwardly facing surfaces of the beam whereby one of the upwardly facing and downwardly facing surfaces extends longitudinally along the second opening.

* * * * *